United States Patent [19]

Stahlecker

[11] Patent Number: 4,592,198

[45] Date of Patent: Jun. 3, 1986

[54] SUCTION CONTROL ARRANGEMENT FOR AN OPEN-END FRICTION SPINNING MACHINE

[75] Inventor: Fritz Stahlecker, Josef-Neidhart Strasse 18, 7347 Bad Uberkingen, Fed. Rep. of Germany

[73] Assignees: Hans Stahlecker; Fritz Stahlecker, both of Fed. Rep. of Germany

[21] Appl. No.: 779,101

[22] Filed: Sep. 23, 1985

[30] Foreign Application Priority Data

Sep. 22, 1984 [DE] Fed. Rep. of Germany ..... 3434873

[51] Int. Cl.[4] ..... D01H 7/882; D01H 7/885; D01H 11/00

[52] U.S. Cl. ..... 57/401; 57/264

[58] Field of Search ..... 57/264, 301, 302, 400, 57/401, 406

[56] References Cited

U.S. PATENT DOCUMENTS 4,007,457 2/1977 Aeppli ..... 57/264

4,094,133 6/1978 Furrer ..... 57/264

4,202,163 5/1980 Turk et al. ..... 57/401

*Primary Examiner*—Donald Watkins

*Attorney, Agent, or Firm*—Barnes & Thornburg

[57] ABSTRACT

An open end friction spinning machine is provided which exhibits a plurality of adjacently arranged spinning units, each spinning unit including two adjacently arranged rollers forming a wedge-shaped gap. Yarn formation takes place inside the wedge-shaped gap with the assistance of a friction effect of the rollers. This friction effect is dependent on the one hand on the outer surface structure of the rollers and on the other hand on the strength of the suction effect of a suction device creating a suction air stream in the wedge-shaped gap. It is provided that the outer surface structure of the rollers is examined so that a portion of the friction effect dependent upon the outer surface of the rollers can be determined. In order to maintain the entire friction effect in a predetermined range, the suction effect of the suction device can be adjusted corresponding to the measured value of the friction effect due to the outer surface of the rollers.

17 Claims, 5 Drawing Figures

36
37
35
34
33
24
25
7
9
8
46
44
39
38
45
47
40
43
42
41
16

SUCTION CONTROL ARRANGEMENT FOR AN OPEN-END FRICTION SPINNING MACHINE

BACKGROUND AND SUMMARY OF THE INVENTION

The invention relates to an open end friction spinning machine with a plurality of spinning units which respectively include two adjacently arranged friction rollers drivable in the same rotational direction and forming a yarn forming wedge-shaped gap therebetween. In this gap, yarn is spun with the assistance of a friction effect on the fibers guided thereto. The friction effect is created with the assistance of the outer surfaces of the rollers in conjunction with a suction air stream in the wedge-shaped gap formed by a suction device.

Practical tests have shown that with spinning units for open end friction spinning, which for example are constructed according to DE-PS No. 24 49 583, difficulties are encountered in maintaining the quality of the spun yarn over a long period of time in spite of careful adjustment of the spinning units. This quality deviation occurs at an individual spinning unit and also between several spinning units which had been previously adjusted to the same values.

An objective of the present invention is the provision of an open end friction spinning machine of the abovementioned kind wherein the causes for a variation in yarn quality is determined.

Another objective of the present invention is the provision of an open-end friction spinning machine capable of initiating counter measures for eliminating variation in yarn quality after determination of the causes thereof.

These and other objectives of the present invention are attained in the provision of means for determining the portion of the friction effect attributable to the outer surfaces of the rollers without having these means alter the friction effect.

The invention is based upon the recognition that the primary reasons for quality changes in the spun yarn are changes in the friction effect, which then immediately lead to a change in the yarn quality and the yarn structure. According to the invention, it is possible to examine an essential characteristic upon which the friction effect is based. This essential characteristic is the portion of the friction effect which is affected by the outer surface structure of the rollers.

According to a preferred embodiment of the invention, there is provided a disturbance free functioning sensor for examining the outer surface structure of the examined roller and providing a signal representative thereof. Through the disturbance free functioning there results the advantage that the sensor itself causes no alteration such as abrasion and thereby also does not contribute to changes in the examining effectiveness. The resulting signal is thereby only dependent upon the respective occurring surface structure of the examined roller. Thereby it is especially advantageous to provide an optical sensor, preferably one constructed to be responsive to scattered light. This kind of sensor can be installed with success and can be manufactured today for the examination of the roller surface characteristics.

In further features of the invention, it is provided that the sensor is connected to an evaluating device for receiving signals representing the portion of the friction effect depending upon the surface of the examined rollers. In this case, it is possible not only to determine the respective occurring surface structure but also to evaluate the same qualitatively and determine exemplary permissive tolerance ranges.

In further developments of the invention, the sensor and/or the evaluating device are arranged in a travelling maintenance unit adjustably movable relative to respective spinning units. Thereby it is possible to undertake a relatively high expense for examination of the surfaces of the rollers and determination of the corresponding friction effect, without undue influencing of the economics of the entire machine. This is so because the servicing or maintenance unit can be used for a plurality of spinning units. Thereby it is advantageous if the maintenance unit is outfitted with means for adjusting the sensors to at least one of the rollers of a spinning unit. These means for adjusting the sensors are advantageously so constructed that they are adjustable to respectively several positions of a roller so that the overall surface structure of the roller can be examined over a large area. The received signal and evaluation are thereby statistically reliable. It is especially advantageous according to a further development of the invention that the maintenance unit be provided with means for controlling the drive of the rollers. Thereby, it is possible to examine the outer surface structure of the rollers over a portion of the circumference. Accordingly, a statistically reliable measurement can be determined. If a common drive is provided for the rollers of several spinning units, the means for controlling the drive of the rollers can then include means for individually stopping and driving the rollers, which can in any event be also combined with brakes. If individual drives for the rollers of the individual spinning units are provided, then the means for stopping and controlling the rollers can include a control device for the individual drives so that they can adjust them for the examination of the cover surface structure with the preferred rotational speeds.

In further developments of the invention it is provided that the maintenance unit is outfitted with means controlled by the evaluation device for stopping and/or marking an examined spinning unit. The maintenance unit thereby stops a spinning unit which is not error free or so marks the same such that a servicing person knows that a servicing process should be carried out on the spinning unit in order to obtain the desired yarn quality. The marking is so selected that it simultaneously shows the servicing person in which manner an adjustment should be carried out, i.e., whether an increase or decrease in the entire friction effect is needed.

In further developments of the invention it is provided that each spinning unit is outfitted with means for adjusting the strength of the suction effect of the suction device acting at the wedge-shaped gap. The servicing person then undertakes an adjustment of the strength of the suction effect in dependence upon the determined deviation and corresponding to the outer surface of the rollers of a spinning unit in order to achieve again a desired overall friction effect for the required quality. Insofar as an individual drive for the rollers of the spinning unit is provided the servicing person also adjusts the rotational speed of the rollers in dependence upon the determined value of the outer surface structure of the rollers.

In further developments in the invention, it is provided that the maintenance unit is outfitted with means guided by the evaluating device for the adjustment of the means for regulating the strength of the suction effect at a spinning unit. Thereby the adjustment of the portion ascertained for the friction effect is automatically carried out. If individual drives for the rollers are provided at the spinning unit, a regulation of the rotational speed for the rollers can be carried out in a corresponding manner auxiliary to the adjustment of the strength of the suction effect or also in place of such adjustment.

In order to facilitate a quantitative adjustment of the overall friction effect with the maintenance device it is provided in further developments of the invention that the maintenance device is connected with means for examining the strength of the suction effect of the suction device of a spinning unit. This means can for example be an examining head which is adjustably movable to the region of the wedge-shaped gap of the rollers which can detect the air flow occurring under pressure and/or the strength of the suction air stream. However, the means can also be formed as a connecting piece connected with a detector that is adjustable to a corresponding connecting piece of the suction device of a spinning unit and which measures the magnitude of the vacuum occurring in the suction device. In a corresponding manner it is also possible to provide the maintenance device with a device for determining the rotational speed of the rollers, especially if an individual drive for the rollers of a spinning unit is provided. Also, the evaluating device of the maintenance unit can be so constructed that the maintenance unit can undertake a test for adjusting the desired friction effect. Only if this adjustment is not feasible because of the adjustment possibilities provided would the corresponding spinning unit be marked and/or shut down so that it is only brought back into operation after elimination of the determined disturbance of the friction effect.

Other objects, advantages and novel features of the present invention will become apparent from the following detailed description of the invention when considered in conjunction with the accompanying drawings.

DETAILED DESCRIPTION OF THE DRAWINGS

Figure 1:
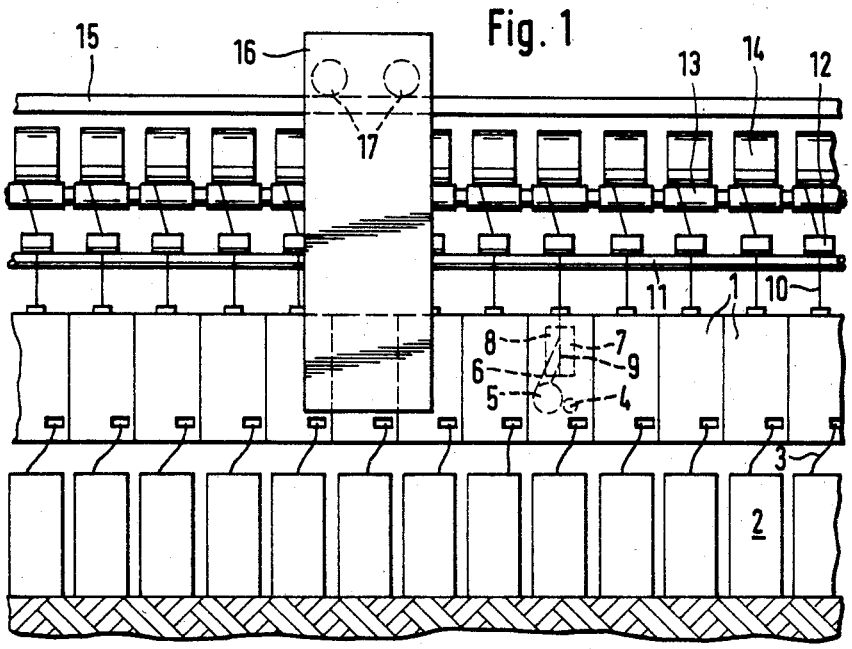
FIG. 1 shows a front view of an open end friction spinning machine having a travelling maintenance unit in accordance with the present inventor.

The open end friction spinning machine according to FIG. 1 includes a plurality of adjacently arranged spinning units 1 which respectively are fed a fiber band 3 to be spun from a can 2. Each spinning unit 1 includes an inlet and opening device with an inlet or feed roller 4 and an opening roller 5 by means of which the fiber band 3 guided thereto is opened into individual fibers which are guided a wedge-shaped gap 9 between the two adjacently arranged rollers 7, 8 through a fiber feed channel 6. The spun yarn 10 is withdrawn in the longitudinal direction of the wedge-shaped gap 9 by means of a withdrawal device which is constructed out of a lower cylinder 11 extending in the machine longitudinal direction and which is driven by respective pressure rollers 12 arranged at each of the spinning units 1. The withdrawn yarn 10 is wound onto a winding spool 14 which is driven by means of a grooved drum 13, which respectively are arranged on a common shaft extending in the machine longitudinal direction.

Travel rails 15 are arranged at the open end friction spinning machine and extend in the machine longitudinal direction. These rails serve to accommodate a travelling maintenance unit 16 which includes travelling wheels 17 engageable therewith, at least one of which wheels 17 being driven. In addition to the devices for examining and adjusting the spinning unit 1 described below, the maintenance unit 16 can also include devices for automatic cleaning of the rollers 7, 8 and/or for the piecing up operation after a yarn break and/or for carrying out a yarn spool change.

Figure 2:
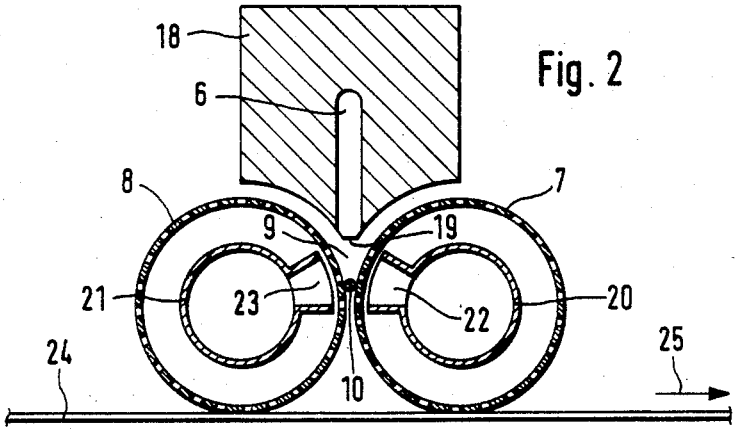
FIG. 2 is a section through a spinning unit of the open end friction spinning machine in the region of two rollers forming a wedge-shaped gap in accordance with the present invention.

In the illustrated embodiment (FIG. 2) the rollers 7 and 8 are constructed as so called suction rollers. They possess a perforated roller surface inside of which suction pipes 20 and 21 are arranged and which (in a not further illustrated manner) are connected to a vacuum source.

The suction pipes 20 and 21 are respectively provided with longitudinal slots 22 and 23 which are aligned with the region of the wedge-shaped gap 9 and extend in the longitudinal direction of this wedge-shaped gap 9. The suction air stream along the longitudinal slots 22 and 23 in the region of the wedge-shaped gap 9 flows through the perforated cover surface of the rollers 7 and 8. The suction air stream serves on the one hand to hold the forming yarn in the wedge-shaped gap 9 and is on the other hand to create an air stream in the fiber feed channel 6 by means of which the transport of the fibers is assisted. As can further be seen in FIG. 2 there is a fiber feed channel 6 which exhibits a slot type mouth extending in the longitudinal direction of the wedge-shaped gap 9 and is located in a partial housing 18 which covers the rollers 7 and 8 in the region of the wedge-shaped gap 9. A tangential belt 24 engages the cover surfaces of the rollers 7 and 8 and extends in the machine longitudinal direction (arrow direction 25 in FIG. 2) and serves to drive the rollers 7 and 8 as well as the rollers 7 and 8 of all remaining spinning units 1 at a machine side.

Figure 3:
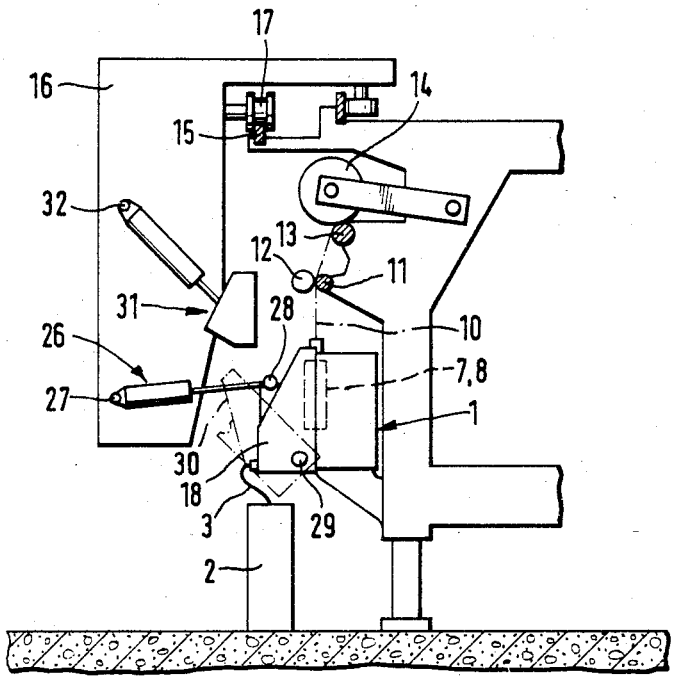
FIG. 3 is a section through an open end friction spinning machine through a spinning unit and an operational maintenance unit positioned at the spinning unit in accordance with the present invention.

The maintenance unit 16 (FIG. 3) is outfitted with an opening device 26 comprising for example, a hydraulic or pneumatic press. The opening device 26 is pivotable about an axle 27. A gripping part 28 of the opening device 26 is adjustable to a correspondingly arranged counterpiece of the partial housing 18 of the respective spinning unit 1 so that the opening device 26 can pivot the partial housing 18 about the stationary axle 29 of the spinning unit 1. In this manner, the position 30 illustrated in dash-dash-dot lines in FIG. 3. Thereby the front side of the rollers 7 and 8 as well as the wedge-shaped gap 9 are accessible for maintenance purposes.

Figure 4:
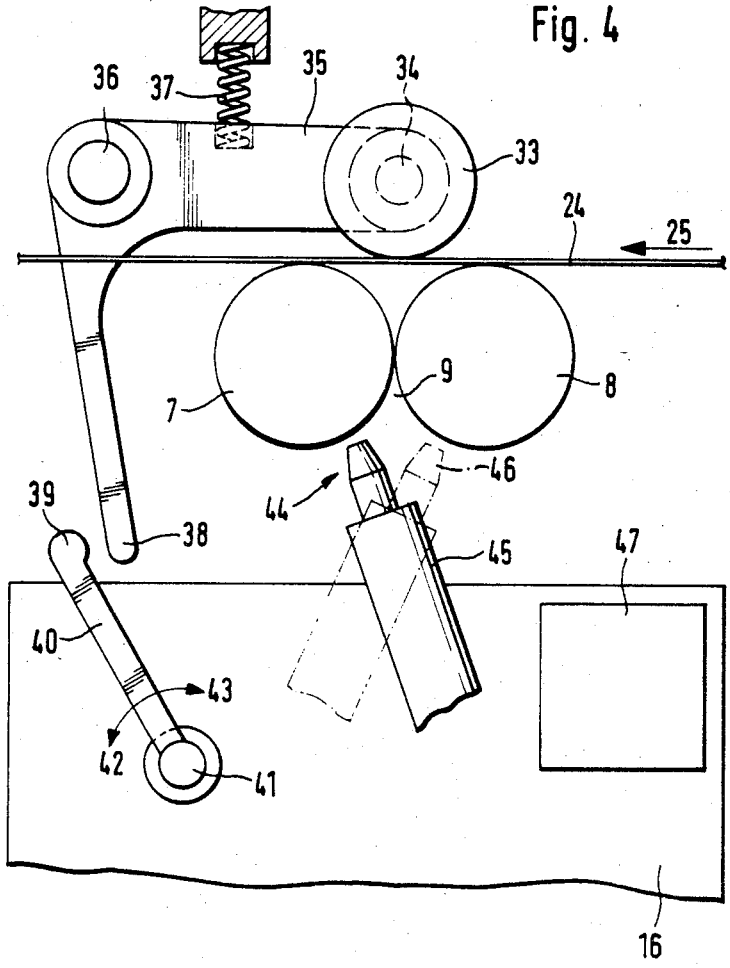
FIG. 4 is a schematic view of a spinning unit and a part of the maintenance device with a sensor which is adjustably movable relative to the rollers in accordance with the present invention.

The maintenance unit 16 further includes a measuring device 31, which is arranged on a pivotal adjusting device for pivotal movement about an axle 32. The adjusting device may include, for example, a hydraulic or pneumatic press. After swinging down of the partial housing 18, the measuring device is adjustably movable to the region of the wedge-shaped gap 9. The measuring device 31 serves to examine the surface structure of the rollers 7 and 8 and to determine the friction effect characteristics of the rollers 7 and 8. The maintenance unit 16 includes a device for interrupting the drive of the rollers 7 and 8 (FIG. 4). The tangential drive belt 24, extending in the arrow direction 25, is biased toward the wedge-shaped plane in the direction of the rollers 7 and 8 by means of the tension roller 33. The tension roller 33 is supported with its axle 34 to be freely rotatable and is disposed on a pivot lever 35 which is pivotably movable about a stationary axle 36. The pivot lever 35 is elastically biased by means of a pressure spring 37 in the direction toward the tangential belt 24. The pivot lever 35 includes an activating arm 38 extending forwardly toward the servicing side of the spinning unit 1. The activating arm 38 serves to displace the tensioning roller 33 in the direction away from the tangential belt 24 through the pivotal movement of the pivot lever 35 so that the drive of the rollers 7 and 8 can be interrupted. The maintenance unit 16 is provided with a pivotable lever 40 which is movable about shaft 41 in the direction of the arrows 42 and 43 by means of which a pressure piece 39 of the activating arm 38 of the pivot lever 35 is adjustably moved. By pivoting the lever 49, the maintenance unit 16 can temporarily interrupt the drive of the rollers 7 and 8. As necessary by means of temporary back and forth movement, the lever 40 can again bring the belt into driving relationship with the rollers.

The maintenance unit 16 (FIG. 4) is further outfitted with a sensor 44 associated with the measuring device 31. The sensor 44 is adjustably movable to a position adjacent to the rollers 7 and 8. By means of an adjusting drive device 45, it can be moved from the FIG. 4 solid line position to the dot-dash illustrated position 46. The adjusting drive 45 is advantageously constructed so that the sensor 44 can also be adjustable in the axial direction along a line at the surface of the rollers 7 and 8 so that it can also examine a large longitudinal region of the rollers 7 and 8. Through temporary switching on of the drive of the rollers 7 and 8 one can furthermore examine several positions of the circumference of the rollers 7 and 8 with respect to its outer surface structure.

Advantageously the sensor 44 functions according to a scattered light process which utilizes the scatter characteristics of the uneven or rough outer surface to determine a characteristic for the roughness of the roller surface. In this arrangement, the surface to be examined is illuminated by means of an intensive infrared bundle of rays. A portion of the transmitted rays are back scattered whereby the angular distribution of the scattered radiation is measured and the surface characteristics for the surface structure of the examined roller cover surface are determined. With the help of an optical analyzing system, the intensity distribution of the back scattered light is measured as a function of the scatter angle so that a signal concerning the cover surface structure of the rollers 7 and 8 is generated. A sensor 44 of this kind is for example available under the mark "Sensor RM400S" from the factory optical works G. Rodenstock of Munich, West Germany.

The sensor 44 is connected to an evaluating device 47 which processes the signal received regarding the cover surface structure of the rollers 7 and 8 and determines therefrom the portion of the entire friction effect dependent upon this friction surface. If the upper or lower tolerance limits for this portion of the friction effect is exceeded, the evaluating device 47 then determines whether the rollers 7 and 8 of the corresponding spinning unit are still in a condition that they can spin yarn with the desired values.

With an advantageous embodiment of the invention, it is provided that the unacceptable deviation of the roller surface characteristics of the rollers 7 and 8 is determined and therewith the unacceptable deviation of the portion of the friction effect, thereby contributed. Either factor can be changed which influences the total friction effect especially the effect of the inflowing suction air stream created by the suction devices 20, 22, 21, 23 in the wedge-shaped gap 9. It is to be noted that both of the rollers 7 and 8 need not be constructed as suction rollers. It is especially possible that the outwardly rotating roller 8 from the yarn forming wedge-shaped gap 9 can be provided with a closed cover surface so that it does not contribute to the creation of the suction air stream. With the development according to FIG. 5, both rollers 7 and 8 are formed as suction rollers so that the below described device must be at least doubled. In the case wherein only one of the rollers 7 or 8 is formed as a suction roller, then correspondingly there is only one such device which is required.

Figure 5:
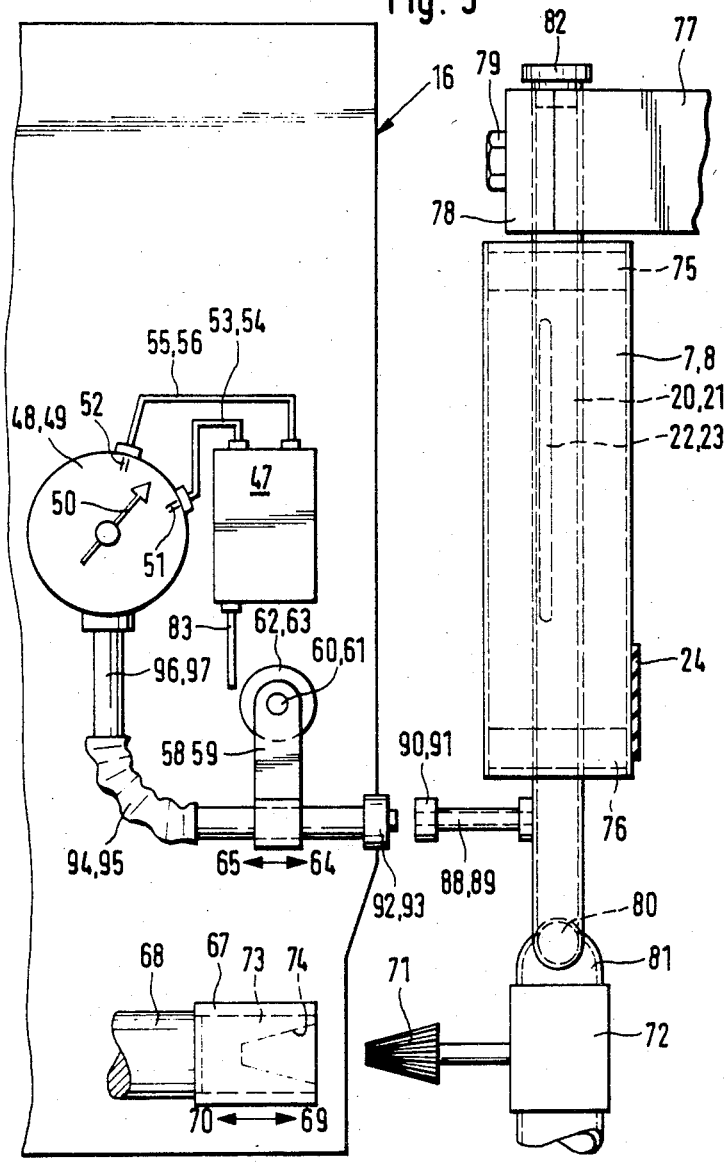
FIG. 5 is another vertical sectional view through a spinning unit and a maintenance device with means for examining and adjusting the suction effect of the suction device of the spinning unit in accordance with the present invention.

At the suction pipes 20 and 21, on which the rollers 7 and 8 are directly rotatably supported and 91 are adjustable to coupling pieces 92 and 93 of the maintenance unit 16. These pieces 92 and 93 open the closing pieces 90 and 91 upon movement in the direction of arrows 64 so that the vacuum in the suction pipes 20 and 21 is communicated with to the maintenance unit 16. The coupling pieces 92 and 93 are held by holders 58 and 59 which are pivotable about axle 60 and 61 with the help of one or two adjusting motors 62, 63 so that the coupling pieces 92 and 93 can carry out connecting and return movement essentially in the direction of the arrows 64 and 65. The coupling pieces 92 and 93 are connected by means of hose lines 94 and 95 to the inlets 96 and 97 of a vacuum detector 48 and 49, which is shown in FIG. 5 as a manometer whose measurements are exhibited respectively by an arrow 50. The vacuum detectors 48 and 49 examine the vacuum existing in the suction rollers 20 and 21. They send a signal, dependent upon the measured vacuum value, to the evaluating device 47 so that these values can be utilized in determining the entire friction effect.

In FIG. 5, it is schematically illustrated that the vacuum detectors 48 and 49 are adjustable, by means of end switches 51 and 52 respectively to yield limit values which establish the desired vacuum range which must exist inside of the suction pipes 20 and 21. These end switches 51 and 52 are connected by means of lines 53, 54, and 55, 56 to the evaluating device 47.

The maintenance unit 16 is further provided with an activating element 67 that is displaceable in the direction of arrows 69 and 70 to be engageable with adjusting elements 71 of a regulating valve 72. The regulating valve 72 is disposed in the maintenance line 81 in front of a branch 80 for the two suction rollers 20 and 21. The adjusting element 71 is formed out of a conical member which is insertable into a corresponding complementary conical recepticle 74 of a coupling part 73 of the activating element 67 to achieve a form fitting connection. The activating element 67 is arranged on a shaft 68 which by means of an adjusting motor (not further illustrated) can be precisely adjustably moved in both rotational directions. The drive of the shaft 68 is controlled by means of the evaluating device 47 through the schematically illustrated line 83 leading to the adjusting motor for the shaft 68.

The maintenance unit 16 runs along the spinning machine and periodically examines the cover surface structure of the rollers 7 and 8. An examination is also conducted under certain special conditions, such as for example, a yarn break or spool change. Simultaneously the unit 16 ascertains the portion of the entire friction effect contributed by the cover surface structure. It is determined when the cover surface structure exhibits too small of a portion of this effect, and also the suction effect of the suction pipes 20 and 21 would is routinely examined. When the determined entire friction effect deviate from the desired values, an attempt is made to adjust the entire friction effect to the desired values by changing the suction effect again toward the appropriate value. When this is not possible, the spinning unit 1 is stopped and marked by stopping and marking means 111 of the maintenance unit 16 so that it can not be engaged by and started by an automatic piecing operation.

The spinning unit 1 can then only be brought again into operation if the necessary corrections are made by a servicing person or another automatic maintenance device.

For examining the suctioning effect of the suction devices 20, 21, 22, 23, it is also possible to provide the maintenance units 16 with a measuring head (not illustrated) which is adjustably movable directly to the region of the wedge-shaped gap 9 in order to measure directly the vacuum and/or the air stream of the suction air stream at the wedge-shaped gap.

In case the spinning units 1 are respectively driven by individual drives for the rollers 7 and 8 it is further possible to adjust the rotational speed of the rollers 7 and 8 individually at each spinning unit 1, and compensate for a change in the friction effect, thereby reestablishing the desired quality of the yarn being spun. This rotational speed adjustment can in any event be examined and controlled from the maintenance unit 16.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

I claim:

1. An open-end friction spinning machine having at least one spinning unit including drivable friction surface means defining a yarn formation zone, suction air stream means adjacent the yarn formation zone for creating a suction effect in the yarn formation zone, said suction effect and said friction surface effect being capable of creating an overall friction effect in said yarn formation zone, comprising:

surface friction effect examining means for determining said surface friction effect of said friction surface means, said surface friction effect examining means being capable of determining said surface friction effect without altering said friction surface means.

2. An open-end friction spinning machine according to claim 1, wherein said friction surface examining means comprises non-contact sensor means.

3. An open-end friction spinning machine according to claim 1, wherein said friction surface means comprises a pair of adjacently arranged friction rollers capable of being driven in the same rotational direction, and said yarn formation zone comprises a yarn-forming wedge-shaped gap formed between the pair of rollers.

4. An open-end friction spinning machine according to claim 2, wherein said non-contact sensor means comprises light sensing means.

5. An open-end friction spinning machine according to claim 1, comprising evaluation device means, said surface friction effect examining means being capable of generating signals corresponding to said surface friction effect, said evaluation device means being capable of receiving said signals.

6. An open-end friction spinning machine according to claim 1, comprising travelling maintenance device means, said surface friction effect examining means being disposed in said travelling maintenance device means.

7. An open-end friction spinning machine according to claim 5, comprising travelling maintenance device means, said evaluation device means being disposed in said travelling maintenance device means.

8. An open-end friction spinning machine according to claim 5, comprising travelling maintenance device means, said evaluation device means and said friction surface examining means being disposed in said travelling maintenance device means.

9. An open-end friction spinning machine according to claim 6, wherein said travelling maintenance device means includes adjusting means for adjusting said friction surface examining means relative to said friction surface means.

10. An open-end friction spinning machine according to claim 9, comprising friction surface drive control means for controlling the drive of said friction surface means.

11. An open-end friction spinning machine according to claim 5, comprising travelling maintenance device means, said maintenance device means including stopping means for stopping an examined spinning unit said stopping means being capable of being controlled by said evaluating device means.

12. An open-end friction spinning machine according to claim 5, comprising travelling maintenance device means, said maintenance device means including marking means for marking an examined spinning unit said marking means being capable of being controlled by said evaluating device means.

13. An open-end friction spinning machine according to claim 1, wherein said spinning unit includes suction effect adjusting means for adjusting the suction effect of the suction device means.

14. An open-end friction spinning machine according to claim 13, comprising travelling maintenance device means, said maintenance device means having controlling means for controlling said adjusting means, said controlling means being capable of controlling the suction effect at said spinning unit.

15. An open-end friction spinning machine according to claim 14, comprising evaluation device means, said surface friction effect examining means being capable of generating signals corresponding to said surface friction effect, said evaluation device means being capable of receiving said signals, said controlling means being responsive to said evaluation device means.

16. An open-end friction spinning machine according to claim 15, wherein said maintenance device means includes suction effect examining means for examining said suction effect, said suction effect examining means being capable of generating suction effect signals corresponding to said suction effect, said evaluation device means being capable of receiving said system effect signals.

17. An open-end friction spinning machine according to claim 1, comprising a plurality of spinning units.

* * * * *